US006237482B1

(12) United States Patent
Nishida et al.

(10) Patent No.: US 6,237,482 B1
(45) Date of Patent: May 29, 2001

(54) TRANSFER PRESS

(75) Inventors: Kenji Nishida; Shouji Watanabe, both of Ishikawa (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/214,522

(22) PCT Filed: Sep. 12, 1997

(86) PCT No.: PCT/JP97/03249

§ 371 Date: Jan. 7, 1999

§ 102(e) Date: Jan. 7, 1999

(87) PCT Pub. No.: WO98/16369

PCT Pub. Date: Apr. 23, 1998

(30) Foreign Application Priority Data

Oct. 15, 1996 (JP) ..... 8-272407

(51) Int. Cl.[7] ..... B30B 1/00
(52) U.S. Cl. ..... 100/193
(58) Field of Search ..... 100/193, 207, 100/208, 231; 72/456, 389

(56) References Cited

U.S. PATENT DOCUMENTS 3,233,751 * 2/1966 Bannon ..... 100/207
3,779,155 * 12/1973 Ohno ..... 100/207
4,321,819 * 3/1982 Kraft et al. ..... 72/456
4,543,147 * 9/1985 Noto et al. ..... 100/207
5,595,111 * 1/1997 Michael et al. ..... 100/207
6,000,326 * 12/1999 Nishida ..... 100/193

FOREIGN PATENT DOCUMENTS

P07-080699 3/1995 (JP) .
8-52597 2/1996 (JP) .
P08-118094 5/1996 (JP) .
P09-052200 2/1997 (JP) .

* cited by examiner

*Primary Examiner*—Peter Vo
*Assistant Examiner*—Louis Huynh
(74) *Attorney, Agent, or Firm*—Ronald P. Kananen; Rader, Fishman & Grauer

(57) ABSTRACT

A transfer press is provided in which a bed (2), a crown (3) and a slide (4) are divided into sections for respective working stations (W1, W2, - - - ) and the respective divided sections are fabricated into a module as a set of press unit, and in such transfer press, a plurality of uprights (5) are disposed between the respective bed sections and crown sections, the bed sections and the crown sections are coupled and fastened by means of tie rods (6) inserted into the uprights, and reinforcing means (10) are disposed to the uprights at positions higher than a lower dead point of the slide sections for coupling adjacent uprights together.

6 Claims, 5 Drawing Sheets

TRANSFER PRESS

TECHNICAL FIELD

The present invention relates to a transfer press having an improved rigidity in a horizontal direction thereof.

BACKGROUND ART

A conventional transfer press is provided with a press body into which a plurality of working stations are arranged, in which workpieces are subsequently transferred from an upstream side of the working stations towards a downstream side thereof during which the workpieces are worked at the respective working stations.

Japanese Patent Laid-open (KOKAI) Publication No. HEI 8-52597 discloses a transfer press in which a bed, a crown, a slide and the like, which constitute a press body, are divided into sections for the respective working stations, and these divided ones are fabricated into a module as one set of press unit for each of the working stations.

The conventional transfer press of the structure, for example, mentioned in the above publication is assembled at an installation site after preliminarily manufacturing the respective bed sections, crown sections and slide sections in the divided states in a manufacturing factory and conveying them to the installation site, so that it is advantageous that these divided sections can be conveyed with no specific limit in the conveyance even if a large-sized transfer press is installed.

However, in the conventional transfer press disclosed in the above publication, since it is fabricated into a module in each of the working stations, it is necessary to provide uprights for supporting the crown section in each of the working stations. For this reason, when a width of the upright is made large for ensuring the strength thereof, it is obliged to make large a pitch between adjacent two working stations because of the following reason.

That is, the conventional transfer press is provided with a moving bolster, capable of being freely inserted into or drawn out of the press body, for easy exchanging of a mold, and in the transfer press which is fabricated into a module in each of the working stations, such moving bolsters are provided for the respective working stations. Such moving bolsters are passed through a space between adjacent uprights when the moving bolsters are inserted into or drawn out of the press body.

Because of the reason mentioned above, it is necessary to keep the space between the respective uprights sufficient for the moving bolsters to be inserted or drawn out, and accordingly, if the uprights each having a large width are used, the pitch between the adjacent working stations provided with the moving bolsters is inevitably made large. However, in the case where the pitches between the respective working stations are made large, all processes in the working stations are also elongated and the entire length of the press body will be also made large, resulting in a provision of a large-sized press body which requires much manufacturing cost, thus being inconvenient and disadvantageous.

In order to obviate such defect, in the conventional transfer press, which is fabricated into a module at the respective working stations, it is attempted to reduce the pitch between the adjacent working stations and, hence, to make short the entire length of the press body.

In the conventional transfer press, however, if the width of the upright is made small, the rigidity of the press body in the horizontal direction is accordingly reduced, which may cause a swing in the horizontal direction during the working and it is difficult to expect a precise press molding of the transfer press.

The present invention was conceived to solve or improve the problems or defects of the conventional transfer press mentioned above and to provide a transfer press capable of improving the rigidity in the horizontal direction thereof and performing a press molding with a high precision.

DISCLOSURE OF THE INVENTION

To achieve the above object, according to one embodiment of the present invention, there is provided a transfer press, in which a bed, a crown and a slide are divided into sections for respective working stations and the respective divided sections are fabricated into a module as a set of press unit, wherein a plurality of uprights are disposed between the respective bed sections and crown sections, the bed sections and the crown sections are coupled and fastened by means of tie rods inserted into the uprights, and reinforcing means are disposed to the uprights at positions higher than a lower dead point of the slide sections for coupling adjacent uprights together.

To achieve the above object, according to another embodiment of the present invention, there is provided a transfer press in which a crown is mounted between upper end portions of a plurality of uprights standing upward from a bed, and the crown and the bed are fastened by tie rods inserted into the uprights, wherein a reinforcing means is disposed to the uprights at a position higher than a lower dead point of a slide for coupling adjacent uprights together.

According to the structures mentioned above, since the rigidity of the press body in the horizontal direction is remarkably improved, the press body is never swung in the horizontal direction during the working, thereby a press molding with high precision is performed.

Furthermore, since the horizontal direction rigidity of the press body can be increased without increasing the width of the upright, it is not necessary to make large the pitch of the working station, thus reducing the entire length of the press body, whereby the press body can be made small in size which results in the reduction of the installation space and cost.

In the above structures, it is preferred that a divided crown section of a press unit provided for a first working station and a divided crown section of a press unit provided for a second working station are coupled together by means of a coupling member.

According to this structure, in a case where the press unit for the first working station is separated from the press units of the second and succeeding working stations, the divided crown section of a press unit provided for the first working station and the divided crown sections of the press units provided for the second and succeeding working stations are firmly coupled together by means of the coupling members, so that the rigidity of the entire press body in the horizontal direction can be improved, and also, since the horizontal direction rigidity of the press unit for the first working station can be improved, the working precision in the first working station can be also improved.

Furthermore, in the above structure, it is preferred to arrange the coupling members substantially in parallel to a workpiece conveying direction.

According to this structure, the oscillation caused in a horizontal direction in the press unit for the first working station can be effectively transferred to the press units for the second and succeeding working stations through the coupling members, so that the horizontal direction oscillation caused in the first working station can be effectively reduced.

Furthermore, in the above structure, it is preferred to provide a damping function to the coupling member.

According to this structure, the horizontal direction oscillation and vibration generated in the press unit for the first working station is reduced by the damping function of the coupling members and reducedly transmitted to the press units for the second and succeeding working stations, so that the horizontal direction oscillation and vibration generated in the press unit for the first working station do not give an adverse influence to the second and succeeding working stations, and also, the horizontal direction oscillation and vibration generated in the press units for the second and succeeding working stations do not give an adverse influence to the first working station.

Furthermore, in the above structure, it is preferred to provide a cover member above the reinforcing means.

According to this structure, noise caused by the slide driving mechanism is not diffused therearound, so that the noise can be reduced, and moreover, since the slide driving mechanism is not exposed outside, an outer appearance of the transfer press can be improved.

Still furthermore, in the above structure, it is preferred to fix the reinforcing means to the uprights by fixing means after corner portions of the reinforcing means are positioned by at least one knock pin and a plurality of eccentric pins.

According to this structure, the reinforcing means can be fixed to the uprights firmly and precisely, so that the horizontal direction rigidity can be further improved.

BRIEF DESCRIPTION OF THE DRAWINGS

The present invention will become more understandable from the following detailed description and accompanying drawings representing embodiments of the present Invention. Further, it is to be noted that the embodiments shown in the accompanying drawings do not intend to specify the invention and merely intend to make easy the understanding of the invention.

In the accompanying drawings.

PREFERRED MODE FOR EMBODYING THE INVENTION

The present invention will be described in detail hereunder with reference to the accompanying drawings.

Figure 1:
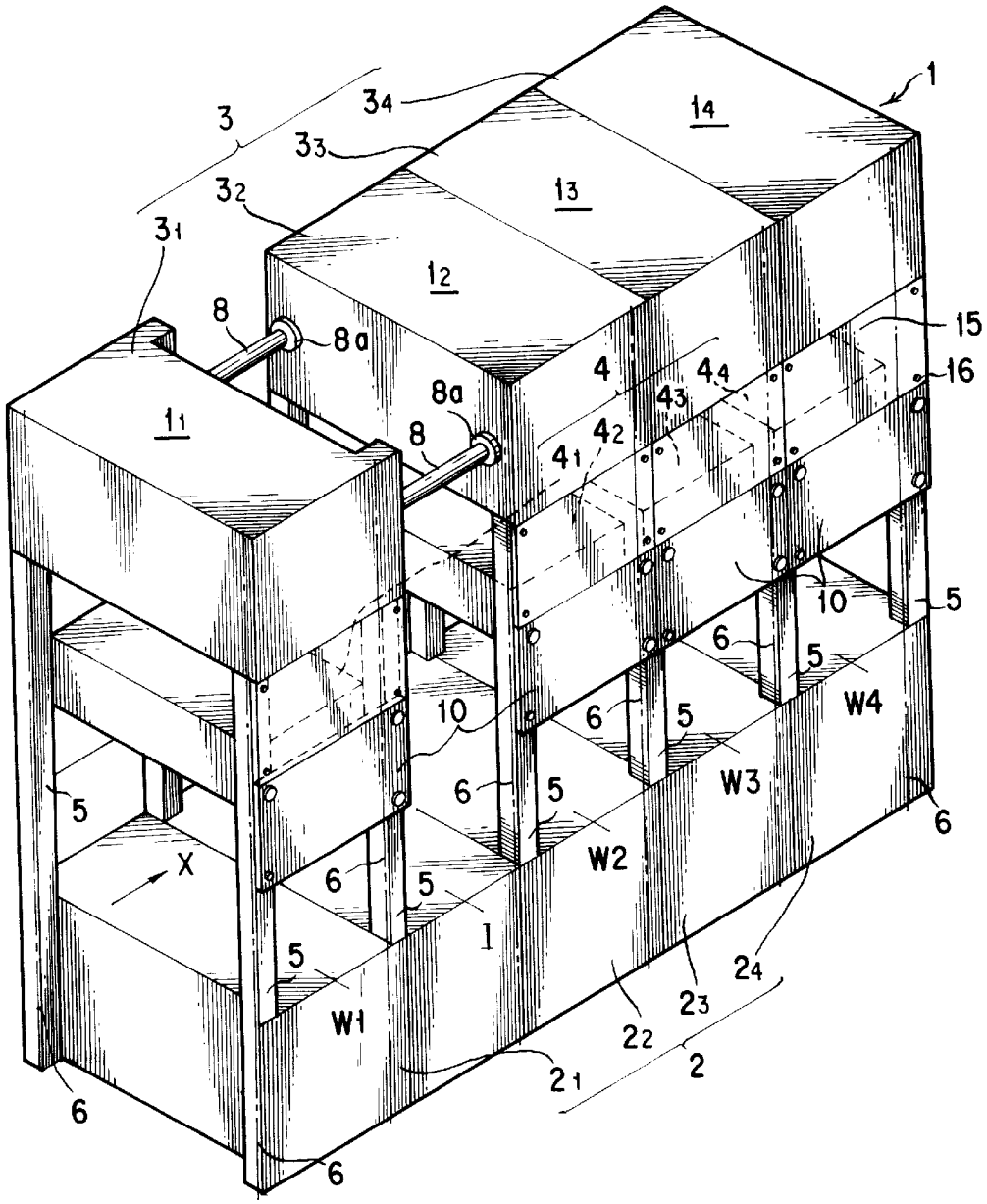
FIG. 1 is a perspective view showing an entire structure of a transfer press according to one embodiment of the present invention.
Figure 2:
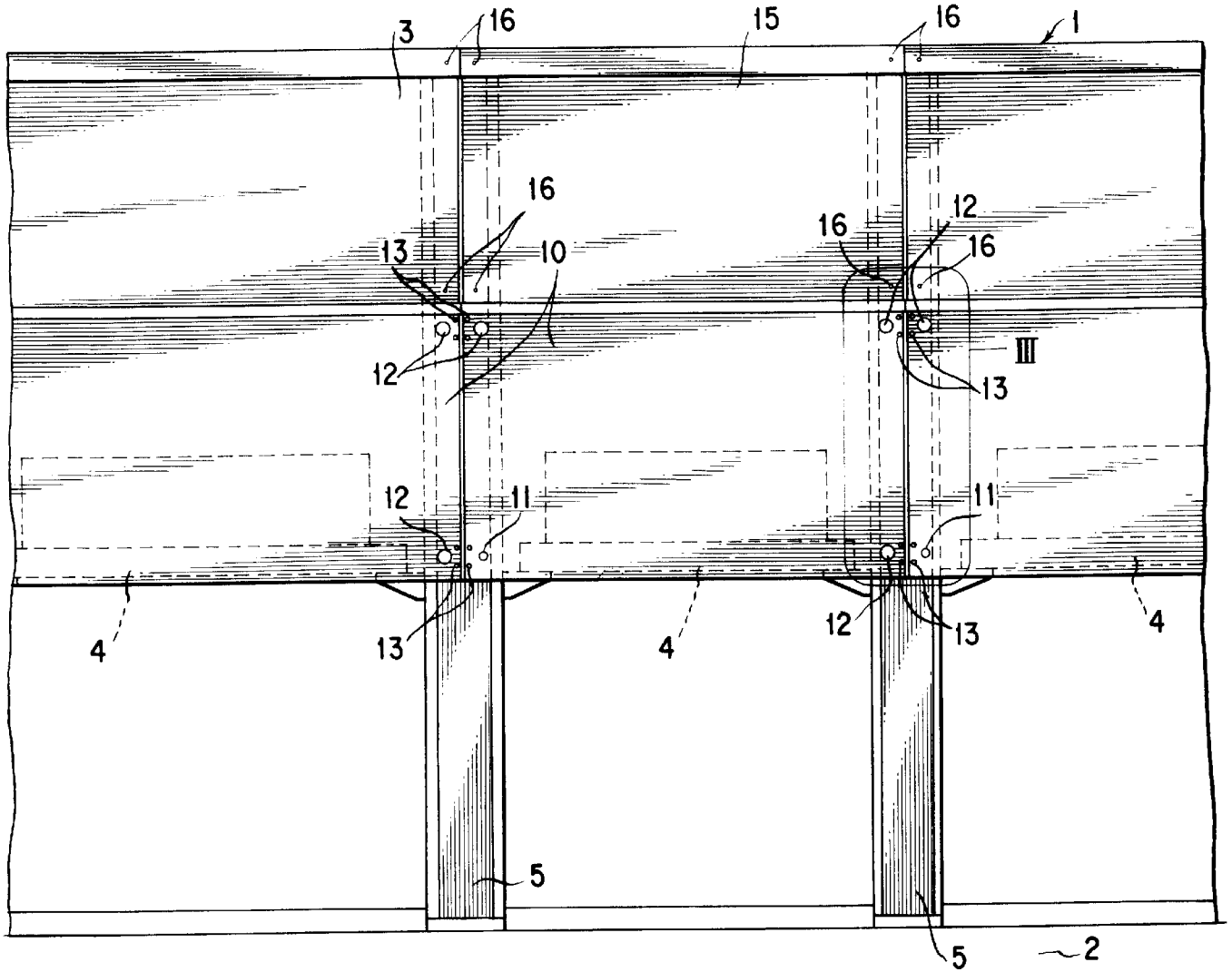
FIG. 2 is a front view of one portion of the embodiment shown in FIG. 1.
Figure 3:
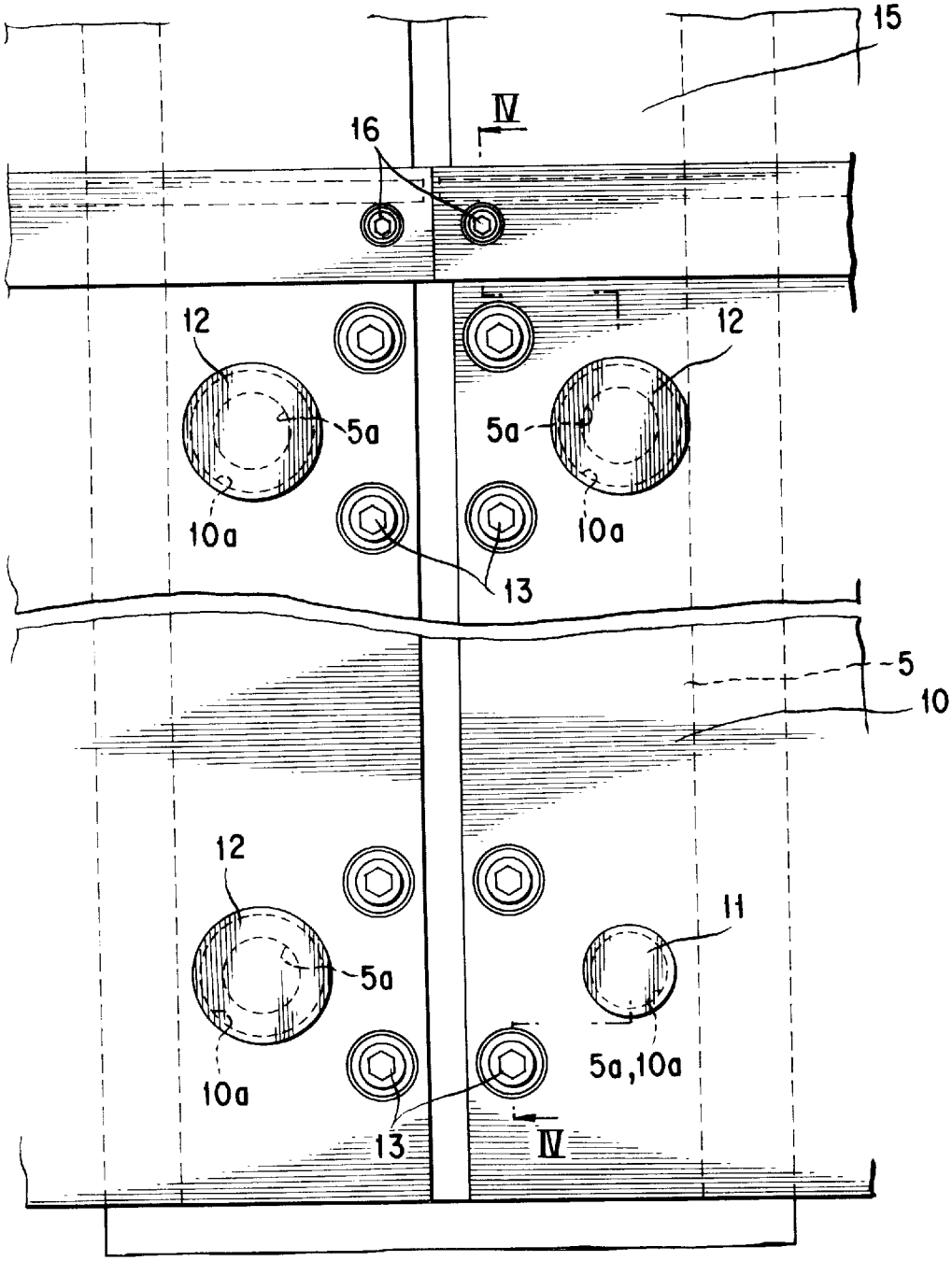
FIG. 3 is an enlarged view of a portion III encircled in FIG. 2.
Figure 4:
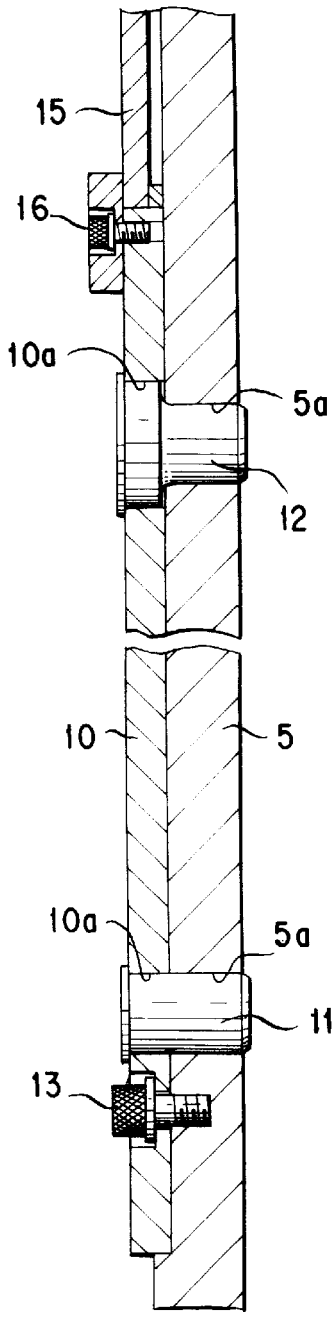
FIG. 4 is a sectional view taken along the line IV—IV in FIG. 3.
Figure 5:
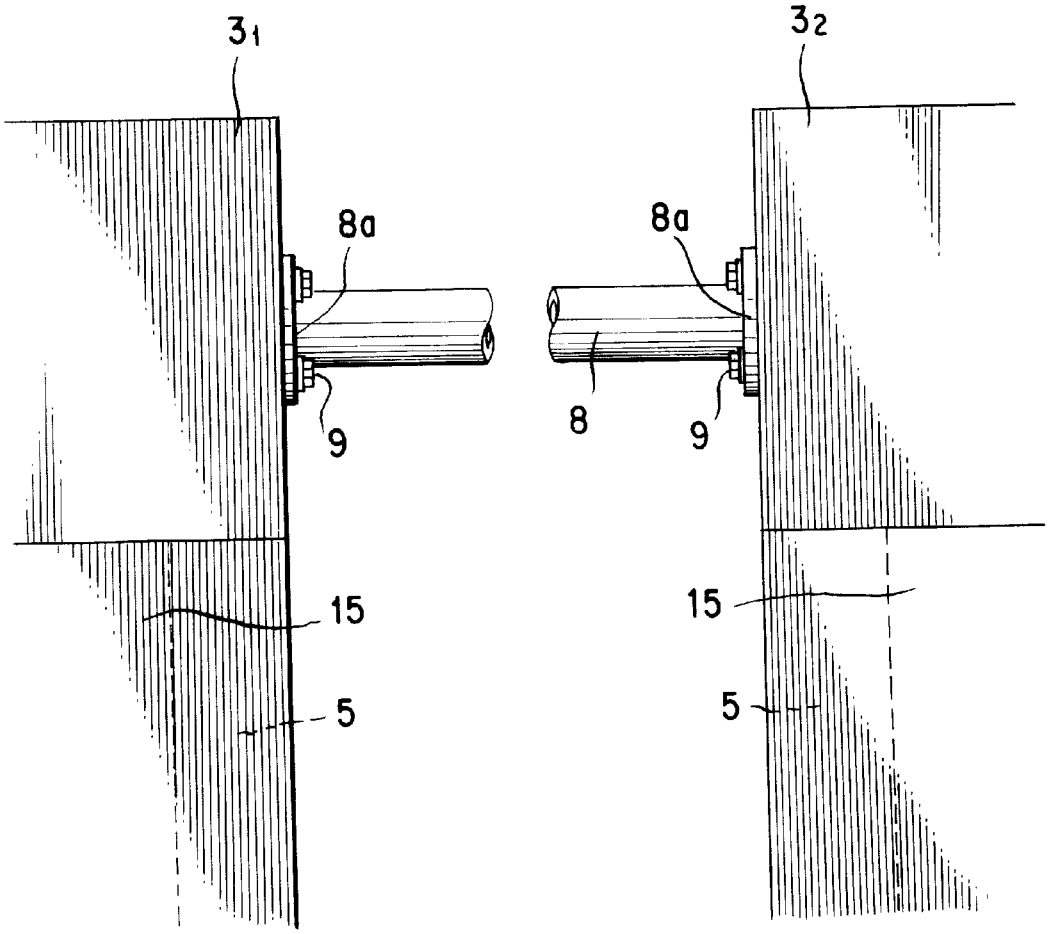
FIG. 5 is a front view in an enlarged scale of a portion near a connecting portion of the embodiment shown in FIG. 1.

FIG. 1 is a perspective view showing an entire structure of a transfer press according to one embodiment of the present invention, FIG. 2 is a front view of one portion of the embodiment shown in FIG. 1, FIG. 3 is an enlarged view of a portion III encircled in FIG. 2, FIG. 4 is a sectional view taken along the line IV—IV in FIG. 3, and FIG. 5 is a front view in an enlarged scale of a portion near a connecting portion of the embodiment shown in FIG. 1.

In these figures, reference numeral 1 denotes a press body, which comprises a plurality of working stations, and a bed 2, a crown 3 and a slide 4 are divided into a plurality of sections for respective working stations W1, W2, - - - . Each bed section, each crown section and each slide section are assembled and fabricated into a module as one set of a press unit for each working station.

A press unit $\mathbf{1}_1$ located at the most upstream side working station W1 is one for performing a drawing fabrication. In this press unit $\mathbf{1}_1$, a divided crown section $\mathbf{3}_1$ is supported between the upper end portions of the four uprights 5 standing upward from four corner portions of a divided bed section $\mathbf{2}_1$, and the crown section $\mathbf{3}_1$ and the bed section $\mathbf{2}_1$ are connected and fastened together by means of tie rods 6 inserted into the uprights 5.

A slide drive mechanism, not shown, is disposed within the crown section $\mathbf{3}_1$ so that a divided slide section $\mathbf{4}_1$ disposed below the crown section $\mathbf{3}_1$ is driven vertically by this slide drive mechanism.

Further, press units $\mathbf{1}_2$, $\mathbf{1}_3$ and $\mathbf{1}_4$ positioned to the working stations W2, W3 and W4 are provided with divided bed sections $\mathbf{2}_2$, $\mathbf{2}_3$ and $\mathbf{2}_4$ for the respective working stations W2, W3 and W4, and these bed sections $\mathbf{2}_2$, $\mathbf{2}_3$ and $\mathbf{2}_4$ are firmly coupled integrally with the bed section $\mathbf{2}_1$ of the press unit $\mathbf{1}_1$ by coupling means, not shown.

Uprights 5 each having a small width stand upward from four corner portions of the respective bed sections $\mathbf{2}_2$, $\mathbf{2}_3$ and $\mathbf{2}_4$, and divided crown sections $\mathbf{3}_2$ , $\mathbf{3}_3$ and $\mathbf{3}_4$ are supported respectively between upper end portions of the uprights 5, the crown sections $\mathbf{3}_2$, $\mathbf{3}_3$ and $\mathbf{3}_4$ being firmly coupled integrally with each other by coupling means, not shown.

The respective bed sections $\mathbf{2}_2$, $\mathbf{2}_3$ and $\mathbf{2}_4$, and the respective crown sections $\mathbf{3}_2$, $\mathbf{3}_3$ and $\mathbf{3}_4$ are coupled and fastened with each other by means of tie rods 6 inserted into the respective uprights 5. Slide drive mechanisms, not shown, are disposed within the respective crown sections $\mathbf{3}_2$, $\mathbf{3}_3$ and $\mathbf{3}_4$ so that divided slide sections $\mathbf{4}_2$, $\mathbf{4}_3$ and $\mathbf{4}_4$ disposed below the crown sections $\mathbf{3}_2$, $\mathbf{3}_3$ and $\mathbf{3}_4$ are driven vertically by these slide drive mechanisms, respectively.

Furthermore, the crown section $\mathbf{3}_1$ of the press unit $\mathbf{1}_1$ for the first working station W1 and the crown section $\mathbf{3}_2$ of the press unit $\mathbf{1}_2$ for the second working station W2 are positioned apart from each other in the front and rear direction and firmly coupled together by means of a pair of coupling members 8 extending substantially in parallel to a workpiece conveying direction X.

As shown in FIG. 5, the coupling members 8 are formed of steel pipes, for example, having both ends to which flanges 8*a* are welded, the flanges 8*a* being fastened to opposing surfaces of the corresponding crown sections $\mathbf{3}_1$ and $\mathbf{3}_2$ by fastening means 9 such as bolts.

The adjacent uprights 5, 5 (which are arranged in parallel to the workpiece transferring direction X) are coupled together by reinforcing means 10 provided for the press units $\mathbf{1}_1$, $\mathbf{1}_2$, $\mathbf{1}_3$ and $\mathbf{1}_4$.

The reinforcing means 10 has a function to increasing a rigidity in the horizontal direction (workpiece transferring direction) of the entire structure of the press body 1 by mutually coupling the lateral uprights 5, 5 in the respective press units $\mathbf{1}_1$, $\mathbf{1}_2$, $\mathbf{1}_3$ and $\mathbf{1}_4$. The reinforcing means 10 is composed of, for example, a steel plate and the respective reinforcing means 10 are disposed above lower dead positions of the slides $4_1$, $4_2$, $4_3$ and $4_4$ so as not to abstract the charging of a mold when the mold is exchanged in the following manner.

That is, as shown in FIG. 3, attachment holes 10*a* are perforated to four corner portions of each of the reinforcing means 10, in which, for example, a left lower hole is formed as a positioning hole 10*a* into which a knock pin 11 is inserted.

To the other three holes 10*a*, eccentric pins 12 will be inserted, when these holes are shifted from attachment holes 5*a* perforated on the side of the uprights 5, 5.

After the insertion of the pins 11 and 12 into the attachment holes 10*a*, respectively, the reinforcing means 10 are firmly fixed to the uprights 5, 5 by means of fixing members 13 disposed near the knock pins 11 and eccentric pins 12.

Further, in FIG. 1, reference numeral 15 denotes a cover member provided to the upper portion of each of the reinforcing means 10, and the cover members 15 are fixed to the adjacent uprights 5, 5 by fastening means 16. Reference character I denotes an idle station.

The function of the present invention of the structure mentioned above will be described hereunder.

The bed 2, the crown 3 and the slide 4, each divided into sections for each press unit $1_1$, $1_2$, - - - , preliminarily manufactured at a manufacturing factory are conveyed to an installation site. These structural members are firmly assembled integrally by the coupling means at the installation site, so that the bed 2, the crown 3 and the slide 4 for the large sized transfer press can be easily conveyed to the installation site in the divided state.

At the installation site, the bed (bed sections) 2 is first assembled and the uprights 5, 5 are then secured so as to stand upward. Next, the slide (slide sections) 4 are disposed between the respective uprights 5, 5 and, then, the crown (crown sections) 3 is mounted between the upper ends of the uprights 5, 5. The respective crown sections $3_2$, $3_3$ and $3_4$ are firmly coupled integrally with each other by the coupling means. Thereafter, the crown section $3_1$ in the first working station W1 and the crown section $3_2$ in the second working station W2 are firmly coupled by the coupling member 8.

After the completion of the assembling of the press body 1 by the manner mentioned above, the reinforcing means 10 are positioned between the adjacent uprights 5, 5 of the respective press units $1_1$, $1_2$, $1_3$ and $1_4$ and then firmly fixed thereto by the fixing means 13. Under this state, the reinforcing means 10 have a plate-like structure which function as brace members, and accordingly, the rigidity of the press body 1 in the horizontal direction can be remarkably improved to thereby substantially prevent the horizontal swing from causing during the operation of the transfer press.

It is to be noted that the assembling order of the press body 1 is not limited to the order mentioned above.

Further, the coupling members 8 for coupling the crown sections $3_1$ and $3_2$ of the press unit $1_1$ and $1_2$ for the first and second working stations W1 and W2 has a structure having a damping function (oscillation preventing function), and according to the damping function, the horizontal oscillation or vibration caused at the first working station W1 is reducedly transmitted to the press units $1_2$, - - - of the second and succeeding working stations W2, - - - and, also, the horizontal oscillation and vibration caused at the second and succeeding working stations are reducedly transferred to the press unit $1_1$ of the first working stations W1, thus effectively preventing adverse influence due to the horizontal oscillation and vibration from causing.

In the embodiment of the present invention mentioned above, although there is described the transfer press which is constructed by first dividing the bed 2, the crown 3 and the slide 4 into a plurality of sections for the respective working stations W1, W2, - - - and then assembling them to each press unit as a module, the present invention is not limited to such assembling manner, and in a case where the present invention is applied to a general transfer press in which the bed 2, the crown 3, and to reduce the entire length of the press body 1, the slide 4 are integrated and the pitches of the respective working stations are made small and the width of each upright is reduced, the rigidity in the horizontal direction may be improved, and moreover, since the horizontal oscillation can be made small during the operation, the working precision can be improved.

Further, it is a matter that is self-evident to a person skilled in the art that although the present invention is described hereinbefore with reference to the exemplary embodiments, it is possible to make various changes, deletions and additions to the disclosed embodiment without departing from the subject and scope of the present invention. Accordingly, it is to be understood that the present invention is not limited to the described embodiments and includes scopes or its equivalent scope defined by the elements recited in the appended claims.

What is claimed is:

1. A transfer press comprising a bed, a crown and a slide, said bed, crown and slide being divided into sections for respective working stations and the respective divided sections being fabricated into a module as a set of a press unit; a plurality of uprights are disposed between the respective bed sections and crown sections; said bed section and said crown sections being coupled and fastened by means of tie rods inserted into the uprights; and means for reinforcing said transfer press in a workpiece transferring direction, said reinforcing means comprising a plurality of reinforcing means disposed so that each of the reinforcing means connects two adjacent uprights of a press unit at a position higher than a lower dead point of the slide section for coupling the adjacent uprights.

2. A transfer press according to claim 1, wherein a divided crown section of a press unit provided for a first working station and a divided crown section of a press unit provided for a second working station are coupled together by means of a coupling member.

3. A transfer press according to claim 2, wherein said coupling member is arranged so as to be substantially parallel to a workpiece conveying direction.

4. A transfer press according to claim 2 or 3, wherein said coupling member is provided with a damping function.

5. A transfer press according to claim 1, wherein a cover member is disposed above said reinforcing means.

6. A transfer press according to claim 1, wherein said reinforcing means is fixed to said uprights by fixing means after corner portions of the reinforcing means are positioned by at least one knock pin and a plurality of eccentric pins.

* * * * *